United States Patent [19]

Noren

[11] 3,960,407

[45] June 1, 1976

[54] CUTTERS AND METHODS OF CUTTING

[75] Inventor: Carl Anders Noren, Saltsjo-Boo, Sweden

[73] Assignee: Atlas Copco Aktiebolag, Nacka, Sweden

[22] Filed: Sept. 26, 1973

[21] Appl. No.: 400,824

[30] Foreign Application Priority Data

Oct. 3, 1972 South Africa ..... 72/7054
Oct. 3, 1972 South Africa ..... 72/7055

[52] U.S. Cl. ..... 299/17; 175/422; 239/104

[51] Int. Cl.² ..... E21C 25/60

[58] Field of Search ..... 299/17; 83/53, 177; 175/69, 422; 241/1, 15; 125/1; 239/101, 104

[56] References Cited

UNITED STATES PATENTS 3,132,852 5/1964 Dolbear ..... 299/17
3,554,602 1/1971 Chaney ..... 299/17
3,746,108 7/1973 Hall ..... 175/67

FOREIGN PATENTS OR APPLICATIONS 52,813 3/1967 Poland ..... 299/17

*Primary Examiner*—Ernest R. Purser
*Assistant Examiner*—William F. Pate, III
*Attorney, Agent, or Firm*—Eric Y. Munson

[57] ABSTRACT

The invention relates to methods of cutting spallable material such as rock using high pressure water jets. Two jets which preferably diverge cut slits in the material face. These slits are close together so that the material between them spalls out. The invention also provides apparatus for providing such jets.

8 Claims, 14 Drawing Figures

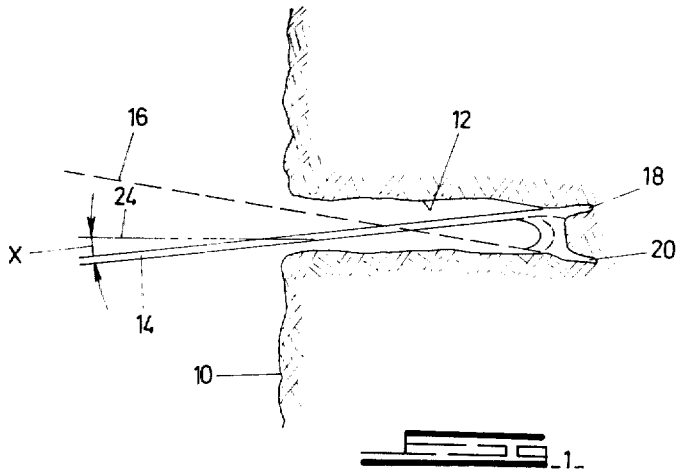
16
12
18
24
X
20
14
10
1
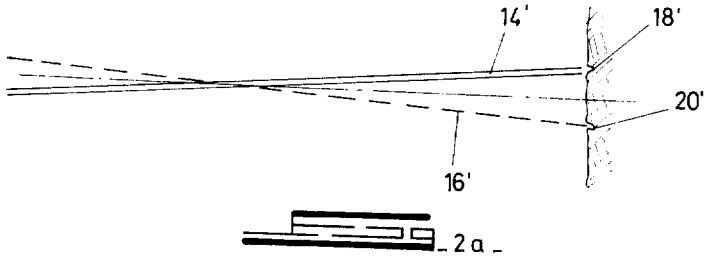
14'
18'
20'
16'
2a
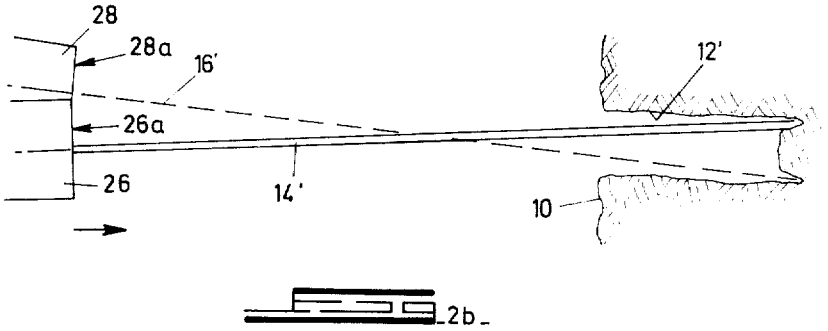
28
28a
16'
12'
26a
26
14'
10
2b
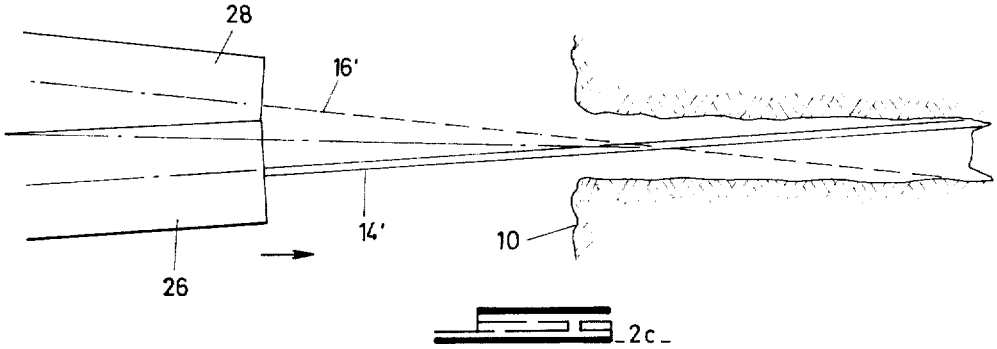
28
16'
14'
10
26
2c

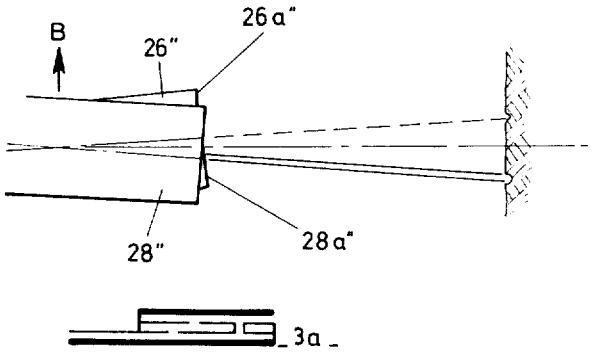
B
26"
26a"
28"
28a"
3a
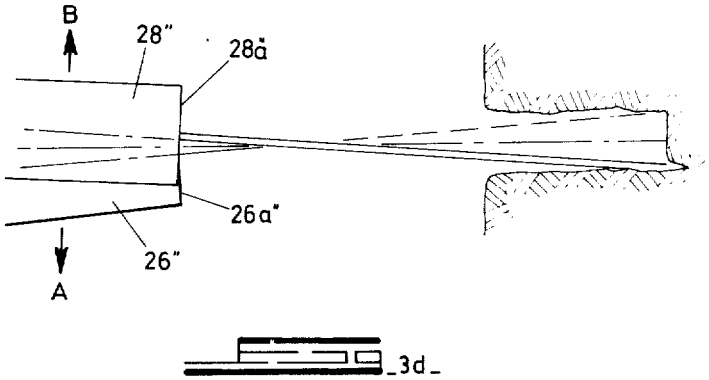
B
28"
28a
26a"
26"
A
3d
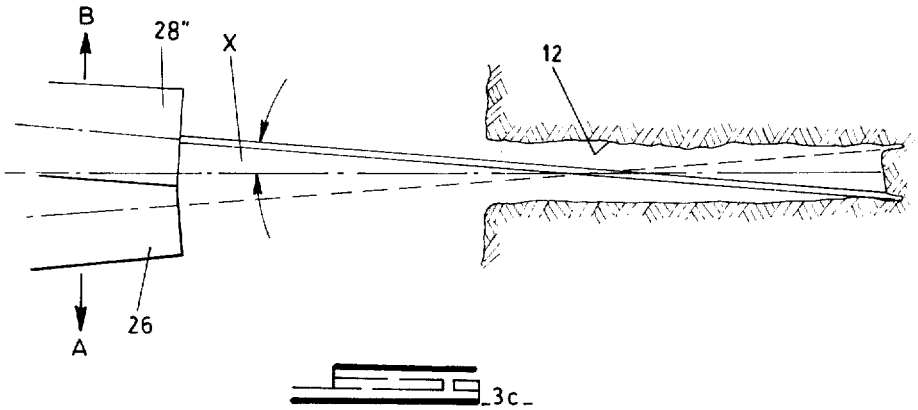
B
28"
X
12
26
A
3c

- 6 -

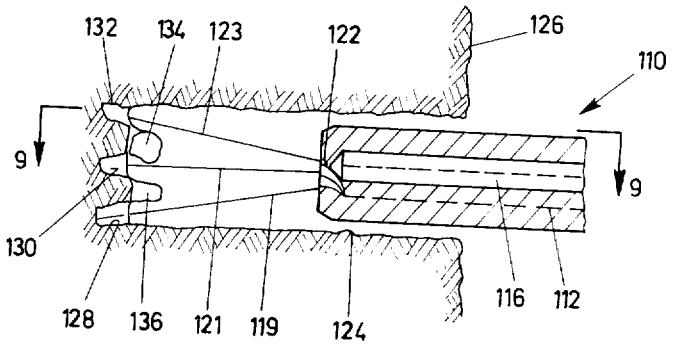
8
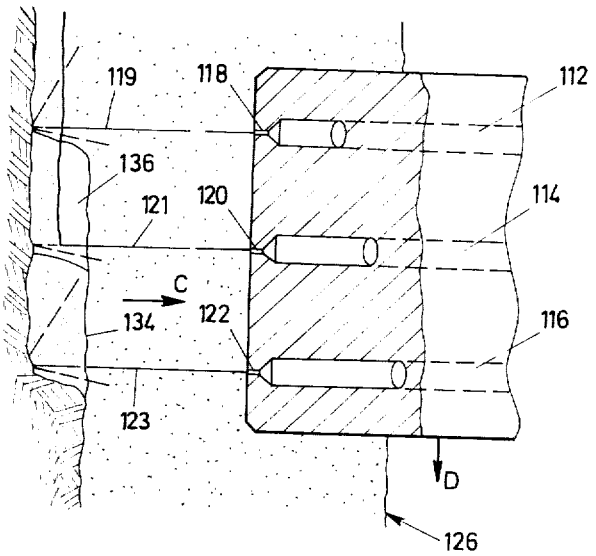
9
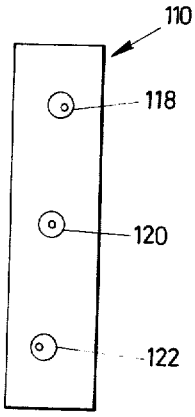
10

CUTTERS AND METHODS OF CUTTING

This invention relates to cutters and to methods of cutting.

This invention is concerned with cutters and methods of cutting and, in particular in relation to cutting rocks, of the kind described in the Complete Specification of Patent Application No. 71/4521. In that specification there is disclosed a method of cutting wherein a cut or cuts are made by water jets being traversed over a surface of the material being cut. Each water jet forms a narrow cut in the material. This cut is hereinafter referred to as a "slit".

According to the present invention there is provided a method of cutting spallable material comprising cutting two slits close to each other in such a way that the material between the slits will spall away thereby leaving an enlarged groove. By the term "spallable material" is meant material such as rock in a mine which, when cut, spalls adjacent to the cut, allowing the parts of the material adjacent the cut to fall or to be worked or be urged free.

Two two slits may be formed simultaneously or, alternatively, in a step-wise fashion, each step in each slit alternating with a step in the other slit. Preferably the jets are arranged to move in paths which diverge towards the base of the groove so that the deepest point of each slit is at or adjacent a corner of the groove and the jet forming the slit will move along a path inclined to the side wall of the groove adjacent such corner. In this way, the drag on the jet by the side walls of the groove (which drag dissipates the power in the jet), will be minimised if not wholly eliminated.

The angle between the centre line of each jet and the centre line of the groove may be fixed or adjustable. The size of such angle should be as large as possible commensurate only with the jet not touching the opposite side of the groove at its open end. The currently preferred size of this angle is between about five to about ten degrees.

With the fixed angle jet arrangement two methods of adjusting the jets are preferred. First the jets may be emitted from two nozzles which are fixed relative to one another and which are moved together closer to the rock face as the depth of the groove increases. Alternatively, the jets may be emitted from nozzles which are movable relative to one another so that as the groove becomes deeper the loci of the jets cross each other (as indeed would be usual with most cuttings apart from the times when the face of the rock is close to the nozzles) and the point of cross-over moves progressively further away from the nozzles.

According to another aspect of the invention, there is provided apparatus for cutting a surface of a spallable material comprising means for transversing a surface of the material, at least two nozzles carried by the traversing means for movement therewith and being adapted to emit jets of water under very high pressure characterised in that the nozzles are arranged to emit jets which diverge in a direction normal to the traversing direction.

The nozzles may be fixed relatively to one another conveniently by being mounted in a nozzle holder which is narrow in the dimension that in use is normal both to the direction of traverse of the jets and the depth of the cut (which dimension is hereinafter referred to as "the width" of the nozzle holder), the nozzle holder containing at least two hydraulic passages lying side by side in the direction of the traverse (the corresponding dimension of the nozzle holder being hereinafter referred to as the "breadth" of the nozzle holder), the hydraulic passages leading to nozzles at the free end of the nozzle holder which nozzles are arranged to direct water pumped through the passages under pressure to form jets diverging when viewed in the direction of traverse. In this way, at least two jets are formed which in use can impinge against the rock face at distances spaced from one another (depending of course on the distance of the nozzles from the rock face) which are greater than the width of the nozzle holder.

The nozzle holder will normally be rectangular in section with the breadth substantially greater than the width. The nozzle holder preferably includes at least three hydraulic passages and nozzles connected respectively thereto so that at least three jets are formed, two being arranged to erode the rock at the edges of the groove and one to erode the base of the groove between such edges. Any convenient number of hydraulic passages and nozzles may be provided although at present a maximum of six is thought to be adequate.

Alternatively, the nozzles may be movable relative to one another. The angle between the nozzles is preferably maintained constant, preferably by pantograph means to which the nozzles are connected.

Embodiments of the invention will now be described by way of example with reference to the accompanying drawings.

In the drawings:

FIG. 1 shows a groove formed in the rock face wall and indicates the loci of the jets forming the groove, FIGS. 2*a*, 2*b* and 2*c* show one method of forming a groove according to the invention, FIGS. 3*a*, 3*b* and 3*c* show another method of forming a groove according to the invention.

FIG. 8 is a section through a nozzle holder of the invention in a groove formed in the rock face, the section being taken normal to the direction of movement of the nozzle, FIG. 9 is a section on line 9 — 9 of FIG. 8, and FIG. 10 is an end view of the nozzle holder taken in the direction of the arrow C in FIG. 9.

Figure 4:
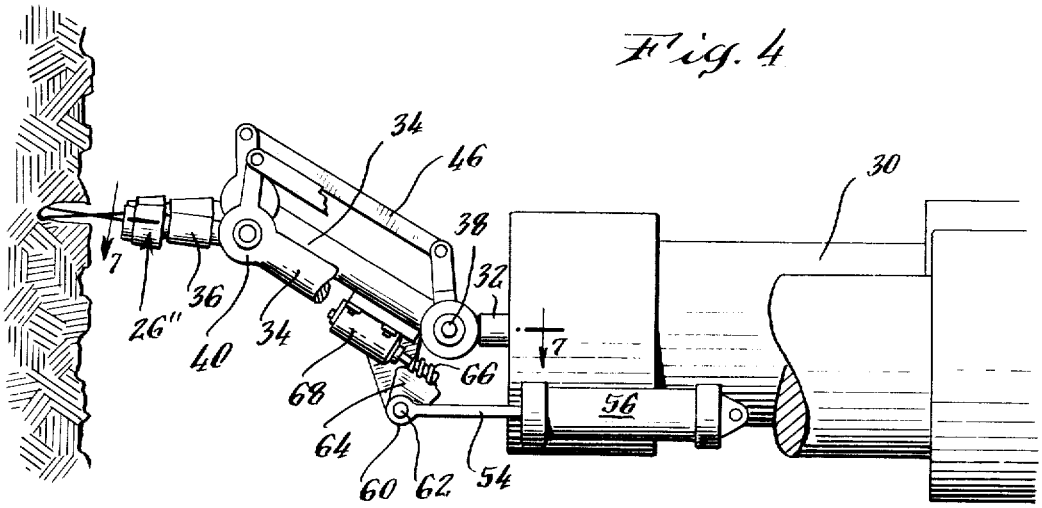
FIG. 4 shows a side view of apparatus of the invention for carrying out the methods disclosed in FIG. 3

(i) General. The locus of the Jets (FIG. 1)

Referring now to FIG. 1, there is shown a rock surface 10 in a stope face. A groove 12 is formed in the rock surface 10. This groove 12 is formed by a pair of jets (the loci of which are indicated respectively at 14 and 16) of water under high pressure. These jets 14 and 16 traverse the rock surface forming slits 18 and 20 in the rock and the material between the slits spalls out to form the groove 12.

It will be noted that each jet extends more or less diagonally across the groove 12, to the corner of the groove at the base, which corner is opposite the side from which the jet enters the groove. Thus, there is virtually no drag on either jet by the side walls of the groove.

The angle between a jet 14 and a line 24 parallel to the centre line of the groove 12 is indicated by X. The angle X is such that at the greatest depth of the groove 12, the jet just misses the front corner of the groove diagonally opposite the slit formed by that jet. The angle X should be as large as possible commensurate with the requirement mentioned in the preceding sentence. It is currently thought than an angle between about five degrees and about ten degrees is a suitable size. The angle X for both jets are preferably the same.

(ii) Fixed Angle Jets from Relatively Fixed Nozzles (FIG. 2)

In FIG. 2 there are shown nozzles 26 and 28 emitting the jets 14' and 16' respectively. The nozzles 26 and 28 are fixed relative to one another. On commencement of the cutting operation (FIG. 2*a*) the end faces **26*a* and 28*a* of the nozzles are far from the rock surface, the slits 18' and 20' are formed and as these slits grow deeper, the rock between them spalls out so that the groove 12' is formed. As the groove 12' becomes deeper, the nozzles 26 and 28 are moved closer to the rock surface 10** (as can be seen from FIGS. 2*b* and 2*c*). This movement can be continuous or can be step-wise, movement taking place after each traverse in one or both directions.

The greatest distance that the nozzles can be from the rock surface to commence the cut is determined by the distance at which the jets disintegrate or break down. For pure water jets this distance is about seventy millimetres. By adding about 0,5% volume/volume of polyoxyethylene to the water, this distance can be considerably increased. The minimum distance of the nozzles from the rock surface is determined by the roughness of the rock surface and the distance allowing for a margin of safety to ensure that the nozzle faces **26*a* and 28*a*** will not strike the rock and be damaged thereby. It follows that this arrangement is most satisfactory when the rock surface is very smooth.

It will be understood that the comments made in section (i) above are applicable to this arrangement as indeed they are to all arrangements described herein unless the contrary is clear.

(iii) Fixed Angle Jets from Relatively Movable Nozzles (FIG. 3)

In this arrangement the nozzles 26'' and 28'' are movable relative to one another. This movement is in the direction of the arrows A and B from a position in which the notional continuations of the jets cross behind the nozzle faces **26*a*'' and 28*a*''** (see FIG. 3*a*) to a position in which the loci cross in the groove 12 (see FIG. 3*c*).

With this arrangement, the distance of the nozzles from the rock surface is maintained constant.

(iv) Practical Embodiment to Carry Out Method of FIG. 3 (FIGS. 4 to 7)

a. General

Figure 5:
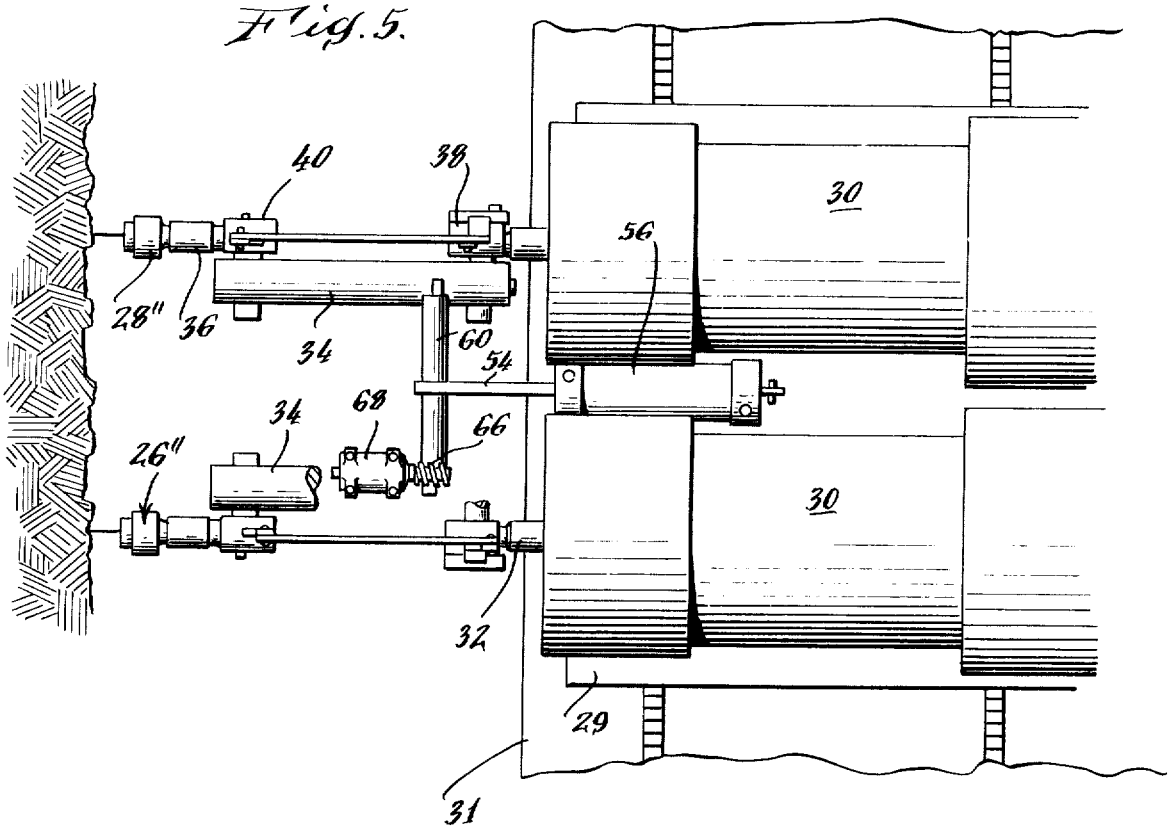
FIG. 5 is a plan view of the apparatus of FIG. 4.
Figure 6:
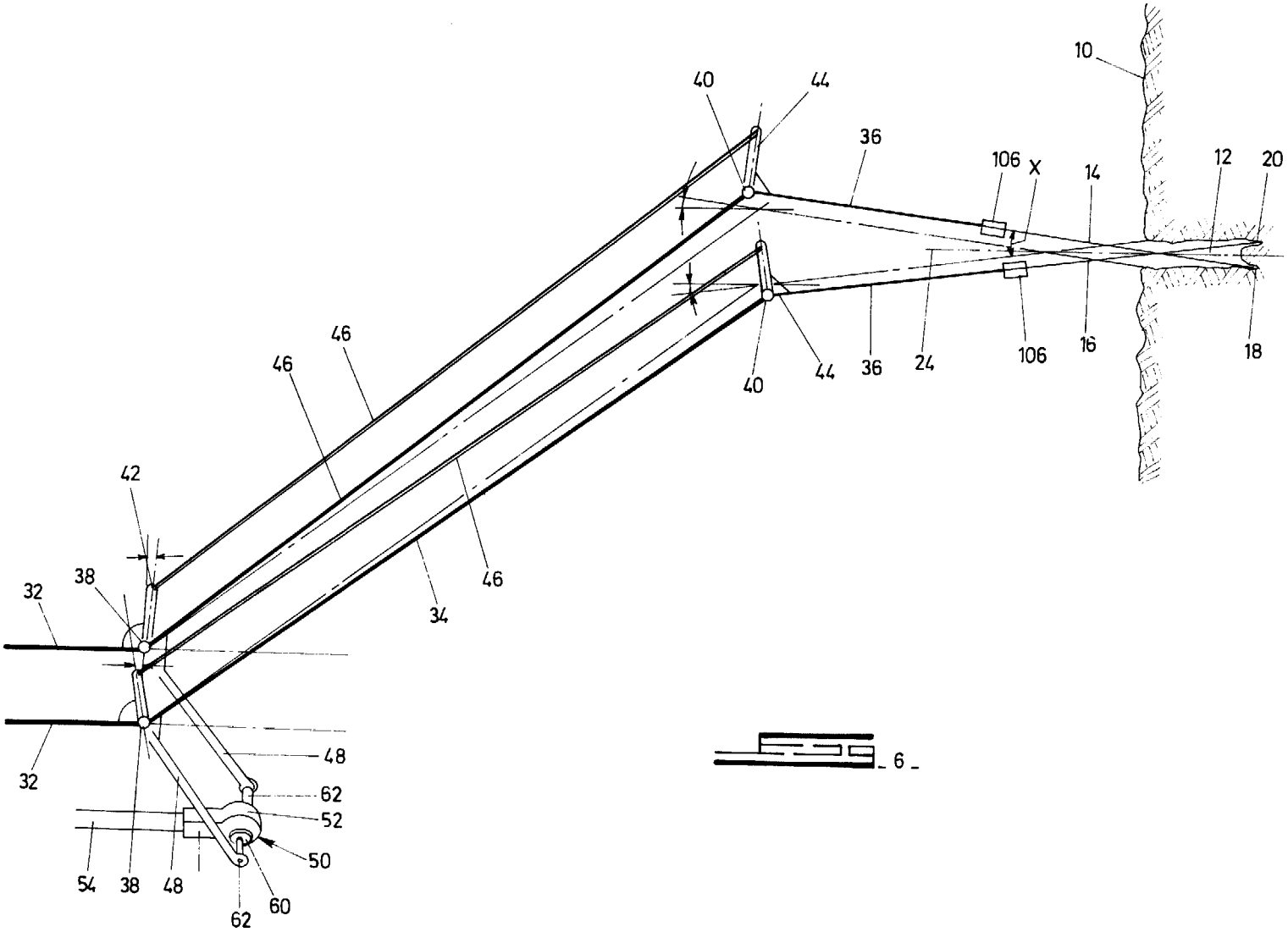
FIG. 6 is a schematic view of the apparatus of FIGS. 4 and 5.
Figure 7:
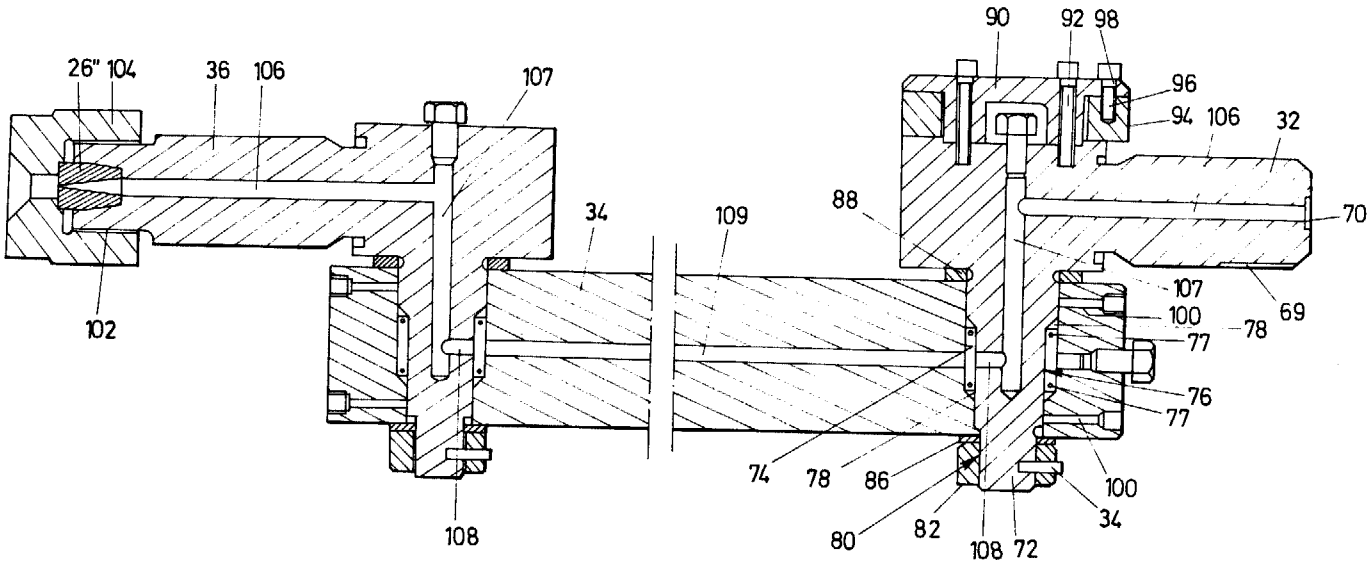
FIG. 7 is a section on line 7 — 7 in FIG. 4.

As the apparatus to carry out the arrangement of FIG. 3 is quite complicated, an embodiment thereof will be described. In FIGS. 4 to 6 there are shown the nozzles 26'' and 28''. Each nozzle is connected to an associated intensifier 30 through a conduit system operated by a linkage. The corresponding parts of the conduit systems and the linkages are of identical sizes. For convenience herein the same parts of each conduit system or linkage are allotted the same reference numerals.

b. The conduit systems (general)

The conduit systems each comprise an intensifier 30. The intensifiers 30 are carried on a plate 29 forming part of a head movably carried by a frame indicated at 31. The frame 31 and head are substantially identical to the corresponding parts described and illustrated in the abovementioned Application.

Each conduit system comprises a tube 32 fixed to the intensifier 30, an intermediate tube 34 and an end tube 36 connected to the nozzle. The intermediate tube 34 is connected at its ends to the free ends of tubes 32 and 36 by swivel connections 38 and 40 respectively. The conduit system is described in greater detail in Section (iv) (e) below.

c. The angle setting linkage (FIG. 6)

The angle setting linkage for setting the angles X comprises a pantograph arrangement including levers 42 and 44 joined by a link 46. Lever 44 is located at swivel joint 40 and is fixedly connected to tube 36 to move the latter. Lever 42 is located at swivel joint 38 and is connected to tube 32. This connection is an adjustable connection.

d. The nozzle moving linkage

The nozzle moving linkage for moving the nozzles relative to one another comprises a pair of lever arms 48 connected respectively to the intermediate tubes 34 at the swivel joins 38. The other ends of the lever arms 48 are connected by a member 50 (to be described). The centre part of the member 50 is received within a bearing 52 carried at the end of a push rod 54 which is connected to an hydraulic actuator 56. This actuator 56 is actuable to swing the lever arms 48 thereby to vary the height at which the groove 12 is formed in the rock surface 10.

The central part 60 of the member 50 is tubular. The end parts 62 of the member 50 are also tubular but are of smaller diameter than central part 60 and are arranged with their axes offset from the axis of the central part (as best seen in FIG. 5). The axes of the end parts 62 are diametrically opposite to one another on the central part. These end parts are rotatably received in the ends of the lever arms 48. A quadrant 64 having a toothed arcuate surface (see FIG. 4) is attached to the central part 60 of the member 50. A worm gear 66 driven by an electric or hydraulic stepping motor 68 engages the quadrant 64 to rotate the member 50.

e. The conduit system (in detail) [FIG. 7].

The free end of fixed tube 32 is threaded at 69 to facilitate connection with the intensifier 30, and is recessed at 70 to ensure a fluid tight seal. A radial spigot 72 is formed on the tube 32 and is received in a recess 74 in intermediate tube 34. The spigot 72 had a reduced diameter portion 76 which is located in the recess 74 and is sealed to the recess by a pair of "O"-rings 77 respectively having support rings 78. The end portion 80 of the spigot 72 is stepped down again and is threaded to receive a nut 82 having a locking pin 84. The end of the tube 34 is held between a washer 86 against which the nut 82 bears and a spacer 88 between the tubes 32 and 34.

A cover 90 is secured by screws 92 to the tube 32 opposite to and co-axially with the spigot 72. Below the cover 90 is an annular space in which a ring 94 is received. A screw 96 passes through an arcuate slot 98 in the cover and engages the ring 94. The lever 42 is secured to the ring 94 and is locked in position by the screw 96. This enables the angle X to be set.

Lubrication conduits 100 are provided for lubricating the spigot.

The swivel joint 40 is similar to the swivel joint 38 subject to this that it does not have the cover 90 and ring 94. Accordingly, this swivel joint 40 will not be described. The lever 38 (not shown in FIG. 7) is secured to the arm 36 in approximately the same position as the lever 40 is secured to the ring 94.

The end 102 of the tube 36 is turned down and threaded. It also has a central recess to receive the nozzle 26'' (or 28'') which is held in position by a nozzle holder 104 which is threaded on to the tube end 102.

The inner and outer tubes 32 and 36 have co-axial bores 106 therethrough meeting bores 107 co-axially within the spigots. The spigots have short radial bores 108 leading from bores 107 to between the O-rings 77 which spaces are connected by a co-axial bore 109 through the intermediate tube 34.

f. Operation

The height at which the groove 12 is to be formed is set by the actuator 56. The nozzle angles are set by links 42 at the angle X mentioned above and the rings 94 and with them the links 42 are locked in position by the screws 96. No further adjustment of the links 42 is necessary. The setting of the nozzles is further such that the jets impinge on the rock face at between five to fifteen millemetres apart. In FIG. 6, the initial position of the intermediate and outer tubes 34 and 36 is indicated in chain dotted lines.

After one or more traverses — i.e. until the slits 18 an 20 are of sufficient depth — the intensifiers are caused to rest and by means of the stepping motor 68 the member 50 is rotated moving the tubes 34 and 36 into the positions shown in full lines. It will be seen that the nozzles are now moved apart and the intersection of the loci of the jets moved closer to the base of the groove 12. As the depth of the groove increases, the nozzles are moved further apart and in this way increase the groove depth still further.

v. Practical embodiment of Fixed Angle Jets from relatively Fixed Nozzles (FIGS. 8 to 10)

In FIGS. 8 to 10 there is shown a nozzle holder 110 which is substantially rectangular in section with the breadth being about three and a half times the width. Within the nozzle holder 110 there are three hydraulic passages 112, 114 and 116 lying parallel to one another in the direction of traverse of the nozzle holder 110. These passages 112, 114 and 116 may be aligned or, as shown, may lie with their centre-lines slightly spaced. These passages 112, 114 and 116 lead to nozzles 118, 120 and 122 respectively.

The nozzles 118, 120 and 122 are shaped to form jets 119, 121 and 123 respectively when the passages are supplied with water under high pressure. The outer orifices 118 and 122 are arranged respectively to direct the jets 119 and 123 so that they diverge from one another. The jets 119 and 123 will in use be directed to the corners of the groove 124 being formed by the jets as will be described. The central nozzle 120 is arranged to direct the jet 121 in a direction normal to the general plane of the rock face 126.

The nozzle holder 110 traverses the rock face 126 in the direction of arrow D in FIG. 9 as will be described. During this traverse, the three jets 119, 121 and 123 form slits 128, 130 and 132 respectively in the rock. Ridges 134 and 136 will be left between the slits 128, 130 and 132 formed by the jets. In practice these ridges 134 and 136 will spall away at about the same rates as the erosion of the slits. Thus, the groove 124 will increase in depth at a substantially continuous rate over a substantially continuous width.

All the hydraulic passages 112, 114 and 116 may be supplied with water under pressure from a single pressure source such as a pressure intensifier especially where there are an odd number of passages. However this is not necessary. For example, when using a double acting pressure intensifier, it may be preferable that there should be an even number of passages and half of them would be connected to one section of the intensifier and the other half of the passages are connected to the other section of the intensifier. Two synchronised single acting intensifiers may be similarly used. In this case, one of the intensifiers will supply water under very high pressure to half of the passages and the other intensifier will supply water under very high pressure to the other half of the passages.

The nozzle holder 110 may be moved in step-wise after each traverse. However, it may be moved inwardly constantly throughout the operation. The inward movement of the nozzle bar holder 110 may be caused by fixing it to the pressure intensifier(s) (not shown) and mounting the pressure intensifier(s) on a cross slide on the traversing table of the cutter unit (as described above).

In use, the nozzle holder 110 is arranged with its end face spaced between thirty and one hundred millimetres from the rock face. The maximum spacing is determined by the length after which the jets break down and the minimum spacing by that length necessary to avoid the nozzle holder being damaged by projections from the rock face. After a number of traverses the depth of the groove 124 will be sufficient for the nozzle holder to enter into the groove 124 Cutting will continue as described above until a deep groove of about 200 millimetres depth or more has been formed.

The hydraulic passages in the nozzle holder may be connected to pressure intensifier means for supplying water under pressure by means of flexible couplings so that the nozzle can be moved further and further into a groove when formed so as to erode a deeper and deeper groove. However, preferably the nozzle is fixed relative to pressure intensifier means and the latter is mounted on a cross slide movably attached to the traversing table on the frame of the cutter. This traversing table is normally the same as the table 22 described and illustrated in our above mentioned Application to which reference is specifically made for information. Thus the pressure intensifier is moved together with the nozzle holder as the latter moves close to and enters the groove.

It will be understood that although the part 110 is being referred to as a "nozzle holder" the nozzles may be, and indeed preferably are, formed integrally in this member rather than being formed separately and hold in position in the nozzle holder.

vi. General Conclusions

We have found that is this way it is possible to cut slots of considerable depth with substantially less power required for pressurising the water for any given groove width or penetration rate as compared to the cutting of the groove with a single jet. Thus, the method above described constitutes an unexpectedly great improvement on the single slit cutter.

The invention is not limited to the precise constructional details hereinbefore described and illustrated. For example, the jets may be parallel. Further, the angle between the jets may be varied. However, the embodiments above described are currently thought to be the most satisfactory. Yet again there are many ways of being able to move the jets relative to one another. For example, two intensifiers may be mounted on a pivotted member equi-spaced from the pivot and means provided to pivot the member. The intensifiers may alternatively be carried respectively by racks which engage a common gear or worm wheel for causing movement in opposite directions.

I claim:

1. A method of cutting grooves in spallable material using high pressure fluid jets comprising:

directing at least two fluid jets towards the material, causing the jets to traverse the material to form narrow slit-like cuts in the material, mutually spacing the jets during their traverse movement in a manner to cause material portions intermediate the slit-like cuts to spall away forming a groove and directing at least the jets forming slit-like cuts adjacent side walls of the groove in a manner such that the jets diverge relative to one another towards the base of the groove and such that each jet does not contact the side walls of the groove so that drag on the jet by the side walls is substantially eliminated, and advancing the jets toward the material as the cutting proceeds thereby maintaining the divergence.

2. A method as claimed in claim 1 wherein at least two jets are directed simultaneously.

3. A method as claimed in claim 1 wherein at least two jets are directed alternately in step-wise fashion.

4. A method of cutting grooves, having parallel side walls, in spallable material using high pressure fluid jets emitted from nozzle-like source means comprising:

directing at least two fluid jets towards the material, causing the jets to traverse the material to form narrow slit-like cuts in the material, mutually spacing the jets during their traverse movement in a manner to cause material portions intermediate the slit-like cuts to spall away forming a groove, directing at least the jets forming slit-like cuts adjacent side walls of the groove in a manner such that the jets diverge relative to one another towards the base of the groove and such that each jet does not contact the side walls of the groove so that drag by the side walls is substantially eliminated, maintaining the angles of the diverging jets, relative to the groove side walls, constant, maintaining the transverse distance between the source means which emit the diverging jets constant during the increase in depth of the groove occurring during the cutting, and moving the source means successively toward the material for maintaining the distance between the source means and the base of the groove substantially constant.

5. A method as claimed in claim 4 wherein the angles between each diverging jet and the side wall, respectively are maintained of equal size.

6. A method of cutting grooves, having parallel side walls, in spallable material using high pressure fluid jets emitted from nozzle-like source means comprising:

directing at least two fluid jets towards the material, causing the jets to traverse the material to form narrow slit-like cuts in the material, mutually spacing the jets during their traverse movement in a manner to cause material portions intermediate the slit-like cuts to spall away forming a groove, directing at least the jets forming slit-like cuts adjacent side walls of the groove in a manner such that the jets diverge relative to one another towards the base of the groove, and such that each jet does not contact the side walls of the groove so that drag by the side walls is substantially eliminated, maintaining the angles of the diverging jets, relative to the groove side walls, constant, maintaining the source means which emit said diverging jets at a constant distance from the surface of the material during the increase in depth of the groove occurring during the cutting, and moving the source means apart from each other in a direction transverse to the groove during the cutting.

7. A method as claimed in claim 6 wherein the angles between each diverging jet and the side wall respectively are maintained of equal size.

8. A method of cutting grooves in spallable material using high pressure fluid jets comprising:

directing at least two fluid jets towards the material, causing the jets to traverse the material to form narrow slit-like cuts in the material, mutually spacing the jets during their traverse movement in a manner to cause material portions intermediate the slit-like cuts to spall away forming a groove, directing at least the jets forming slit-like cuts adjacent side walls of the groove in a manner such that the jets diverge relative to one another towards the base of the groove, maintaining the angle formed between a line taken through the center of each of the diverging jets forming the slit-like cuts adjacent the side walls of the groove and a plane taken through the center of the groove parallel to the side walls of a size such that each jet does not contact the opposite side of the groove at its open end so that drag on the jet by the side wall is substantially eliminated; and adjustably varying the angle as the cutting proceeds.

* * * * *